US005560491A

United States Patent [19]

Romaniuk et al.

[11] Patent Number: 5,560,491

[45] Date of Patent: Oct. 1, 1996

[54] RESCUE ALERT KIT

[75] Inventors: Peter Romaniuk, Beaconsfield; Thomas A. Stanley, Dollard-des-Ormeaux, both of Canada

[73] Assignee: Rescue Alert and Lifeline Products, Inc., Ontario, Canada

[21] Appl. No.: 530,304

[22] PCT Filed: Mar. 28, 1994

[86] PCT No.: PCT/CA94/00186

§ 371 Date: Sep. 26, 1995

§ 102(e) Date: Sep. 25, 1995

[87] PCT Pub. No.: WO94/22534

PCT Pub. Date: Oct. 13, 1994

[30] Foreign Application Priority Data

Mar. 26, 1993 [CA] Canada ..... 2092764

[51] Int. Cl.[6] ..... B65D 85/00; A62B 37/00

[52] U.S. Cl. ..... 206/573; 206/223; 206/232; 206/575; 206/803

[58] Field of Search ..... 206/223, 232, 206/570, 573, 575, 803

[56] References Cited

U.S. PATENT DOCUMENTS

| | | | |
|---|---|---|---|
| 3,254,756 | 9/1993 | Rankin | 206/803 |
| 3,387,698 | 6/1968 | Hendricks et al. | 206/573 |
| 3,951,260 | 4/1976 | Frazee | 206/803 |
| 4,437,568 | 3/1984 | Hamblin | 206/223 |
| 4,471,873 | 9/1984 | Thomas | 206/575 |
| 4,697,706 | 10/1987 | Schaller | 206/573 |

FOREIGN PATENT DOCUMENTS

| | | |
|---|---|---|
| 892190 | 9/1989 | France . |

*Primary Examiner*—Jimmy G. Foster
*Attorney, Agent, or Firm*—Barnard, Brown & Michaels

[57] ABSTRACT

A rescue alert kit (10) is provided herein. The kit includes an envelope, preferably a transparent envelope (20), which includes a reclosable opening (22). A high decibel whistle (27) is secured thereto. The envelope includes elements (23) which enables the envelope to be hung or to be secured to a wall. Within the envelope are a chemiluminescent safety light (70) and fire evacuation safety instructions (40) and optionally also a smoke alarm battery test checklist. In addition, the envelope includes an attention flag (51), the attention flag being rectangular and being made of a material having light reflective, or retroreflective, or phosphorescent, or fluorescent properties, and having a plurality of safety appliques thereon (53, 54, 55). The safety appliques are made from a material having phosphorescent, or fluorescent, or light reflective or retroreflective properties. The attention flag includes a grip, e.g., a suction cup (59) secured thereto. In addition it includes another grip at the free end of a cord (57) secured thereto.

9 Claims, 3 Drawing Sheets

THINK SAFETY FIRST

BECAUSE YOUR SAFETY IS EVERYONE'S SAFETY

SMOKE ALARM "BATTERY TEST" CHECKLIST

YEAR_____

| | | | | | | | | | | | |
|---|---|---|---|---|---|---|---|---|---|---|---|
| JAN | ☐ | ☐ | ☐ | ☐ | ☐ | JUL | ☐ | ☐ | ☐ | ☐ | ☐ |
| FEB | ☐ | ☐ | ☐ | ☐ | ☐ | AUG | ☐ | ☐ | ☐ | ☐ | ☐ |
| MAR | ☐ | ☐ | ☐ | ☐ | ☐ | SEPT | ☐ | ☐ | ☐ | ☐ | ☐ |
| APR | ☐ | ☐ | ☐ | ☐ | ☐ | OCT | ☐ | ☐ | ☐ | ☐ | ☐ |
| MAY | ☐ | ☐ | ☐ | ☐ | ☐ | NOV | ☐ | ☐ | ☐ | ☐ | ☐ |
| JUNE | ☐ | ☐ | ☐ | ☐ | ☐ | DEC | ☐ | ☐ | ☐ | ☐ | ☐ |

9-1-1 EMERGENCY TELEPHONE NUMBERS: 9-1-1

FIRE _____ POLICE _____ AMBULANCE _____

HOSPITAL _____ POISON CONTROL _____

FIG. 5

RESCUE ALERT KIT

TECHNICAL FIELD

This invention relates to a rescue alert kit.

BACKGROUND ART

When a fire breaks out in a building the first priority for people is to evacuate the building. However, there are many instances where it would be unsafe to leave a room in a burning building. Under those circumstances, it is imperative to attract attention of fire fighters to assist in safe evacuation from that room. There has been little done to educate the public on what to do if it is unsafe to evacuate a room.

Moreover, in order to obtain an early warning of the breakout of a fire, it is also necessary to ensure that the battery of a smoke detector is functioning properly.

An emerging fire and smoke safety kit is known from U.S. Pat. No. 4,437,568 patented Mar. 20, 1984 by A. Hamblin. Such kit is formed of metal and is of sufficient size to contain a large variety of emergency equipment, namely, temporary first aid, emergency clothing, breathing apparatus, and means for attracting attention, with a fire extinguisher mounted on the exterior and having a lock on the hinged front.

It would therefore be desirable to provide a kit which can be used to attract attention to persons trapped in a room in a burning building. It would also be desirable to provide such a kit that is useful to assist people in evacuating burning or unsafe buildings.

It is also desirable to enable a person properly to monitor the smoke detector, insofar as the battery is concerned, to ensure that is properly functioning at all times. This is one of the most important aspects stressed by all fire departments to the public when promoting fire safety.

DISCLOSURE OF THE INVENTION

The present invention is provided to meet all these desirable objectives.

This invention provides a portable, very light-weight compact rescue alert kit including means to attract attention enabling rescuers to locate people in danger. The kit is characterized in that it consists of: an envelope, such envelope being formed of thin, pliant material, and having an easily openable and reclosable fastener at its opening; a high decibel whistle secured to the exterior of the envelope; means secured to the exterior of the envelope to enable hanging the envelope on a support or member, or to secure the envelope to a wall or to a body part; a chemiluminescent safety light removably disposed within the envelope; preprinted fire evacuation safety instructions removably disposed within the envelope; and an attention flag removably disposed within the envelope, the attention flag being made of, or being coated with, a material having phosphorescent or fluorescent or retro-reflective properties, and having a plurality of safety appliques thereon, the appliques being made from, or being coated with, a material having fluorescent or phosphorescent or retro-reflective properties, the attention flag including a suction cup and a cord having a grip at the free end thereof secured thereto.

In specific embodiments, the kit is further characterized in that it has one or more of the following features: the envelope is transparent; it also includes a smoke alarm battery test checklist which is removably disposed within the envelope; the hanging means consists of a loop which is secured to the envelope, or consists of a band which is secured to the top and to the bottom of the envelope; the chemiluminescent safety light, once activated, is adapted to shine for at least twelve hours, and it also includes an elastic loop secured to its casing; the attention flag consists of a rectangular strip of vinyl plastic material divided by two score lines to enable folding thereof and to enable such a folded-up attention flag automatically to become unfolded, the vinyl plastic material having a coating thereon of a phosphorescent or fluorescent day-and-night glow material; the safety appliques are formed of synthetic plastic material having phosphorescent, fluorescent or retro-reflective properties; the grip comprises a rod formed of a synthetic plastic having fluorescent or phosphorescent properties, which is tied to one free end of the cord, and the smoke alarm battery checklist consists of a flat plastic or paper plate having either magnets on its rear face to be attachable to a magnetizable surface; or an adhesive surface on its rear face to be attachable to a smooth surface.

BRIEF DESCRIPTION OF THE DRAWINGS

In the accompanying drawings,

FIG. 5 is a copy of the front face of a typical smoke alarm battery test checklist for use in an embodiment of this invention.

BEST MODE FOR CARRYING OUT THE INVENTION

Figure 1:
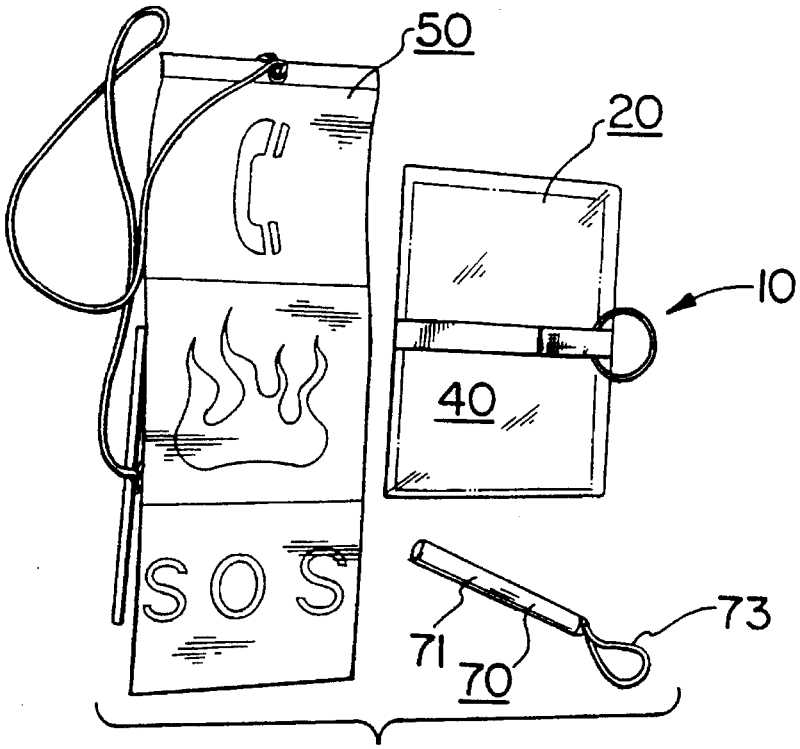
FIG. 1 is a copy of a photograph of the contents of the kit of one embodiment of this invention viewed from the obverse side.
Figure 2:
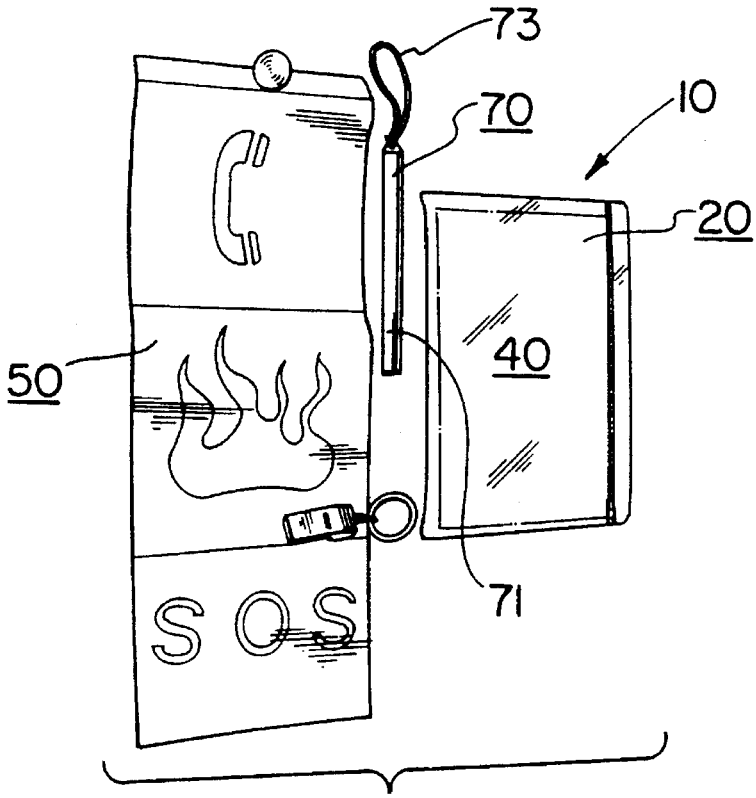
FIG. 2 is a copy of a photograph of the contents of the kit of the embodiment of this invention of FIG. 1 viewed from the front side.

As seen in FIGS. 1 and 2, the kit 10 of one embodiment of this invention includes a transparent envelope 20, fitted with fire safety instructions 40, an attention flag 50 and a safety light 70.

Figure 3:
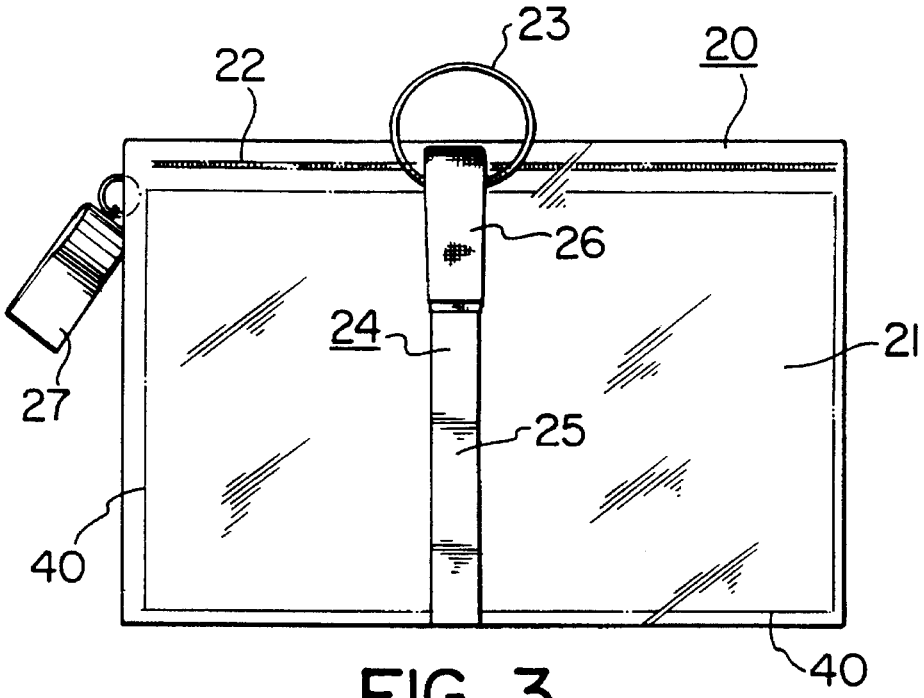
FIG. 3 is a view of the transparent container forming part of the kit of the embodiment of this invention of FIG. 1 viewed from the obverse side.

As seen in FIG. 3, the transparent envelope 20 is an envelope 21 made of transparent plastic material, i.e. vinyl, or MYLAR™. The envelope 21 includes a reclosable fastener 22, which, as shown, is a slidable reclosable fastener (ZIPPER™), but which can be hook-and-loop fasteners (VELCRO™). The envelope 21 also includes a loop 23 which may be used to hang the envelope, e.g., on a door knob. The obverse side of the envelope includes a band 24, part of which is an elastic band 25, the remainder of which is a VELCRO™ strip 26. The envelope 21 also has a high decibel whistle 27, attached thereto, e.g., that known by the trade-mark FOX™ 40, of 130–160 decibels.

Within the envelope 21 is a set of fire safety instructions 40. While all fire safety instructions are different, typical such instructions may be as follows:

"1. Test the door. If the door is hot do not open it. The door is tested by using the back of your hands. If the door is hot, take your second way out; if not, brace your shoulder against the door and open it carefully, being ready to close it quickly if heat or smoke rush in.

2. Go to the window, and place attention sign out of window.
3. Blow the whistle for help.
4. Use the safety light. This may be done by breaking the seal, and bending once. Then snap and shake to initiate the light. Wave the safety light at the window.
5. Stay at the window, and wait for fire fighters.
6. If you are trapped, maintain closed doors between yourself and smoke. Stuff cracks and cover vents to keep smoke out. Wait at the window and signal with the safety light and the attention sign.
7. If it is possible to leave the room, crawl fast and stay low to escape smoke. Smoke rises, while clean air stays low near the floor so get down on your knees and crawl, maintaining contact with the walls as you head to the nearest exit."

Figure 4:
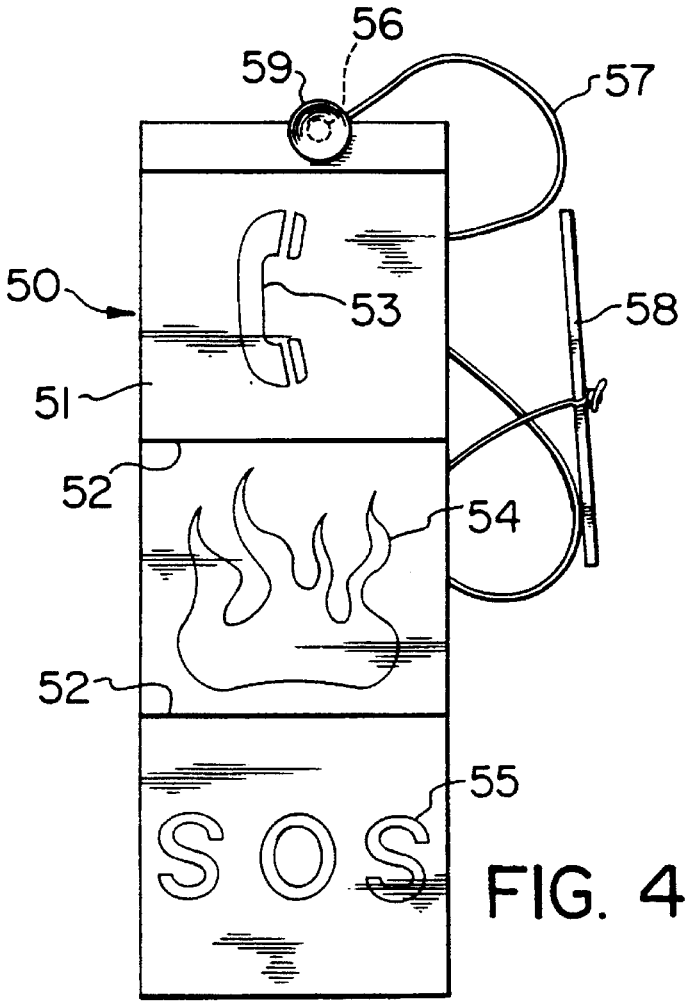
FIG. 4 is a view of the attention flag forming part of the kit of the embodiment of this invention of FIG. 1, viewed from the obverse side.

As seen in FIG. 4, the attention sign 50 consists of a rectangular sheet 51 of plastic provided with two vertical/horizontal score lines 52 to enable the sign 50 to be folded up but to drop to its full length when lifted. The sign 50 is formed of a plastic material, e.g., vinyl plastic, having a coating thereon, preferably of a phosphorescent or fluorescent day-and-night glow material. On the sign 50 are three international symbols, e.g., "telephone" 53, "fire" 54 and "SOS" 55. The symbols are appliques formed of plastic material having, e.g., phosphorescent, or fluorescent, or retroreflective properties.

The upper end of the sign 50 is provided with an aperture 56 through which is attached a non-extensible cord 57. The other end of the cord 57 is attached to a handle 58. Also adjacent the aperture 56 is a suction cup 59.

The safety light 70 is shown in FIGS. 1 and 2. It consists of a flexible plastic tube 71 filled with a liquid chemiluminescent material. When activated, as by bending the flexible plastic tube 71 containing such material, it shines for at least twelve hours. One commercially available such chemiluminescent safety light is that sold under the trade-mark CYALUME™. The light 70 also includes an elastic strap or wrist loop 73.

As seen in FIG. 5, the smoke alarm battery test checklist may be a plastic plate of rectangular shape provided with magnets on the back side or with two-sided stick-on tape to be able to attach to a metal or smooth surface, e.g., a refrigerator or wall. It may alternatively be made in a printed self-adhesive type paper such as "Mac Tac" that will have the wording printed on two faces as, for example, in the form of two facing pages of a book. The rear face will stick to any flat surface. The proposed size of this item will be approximately 4"×6" but will depend on the final graphics and wording.

Suitable and typical instruction for its use are as follows:

Statistics show that 50% of all battery operated smoke alarms in homes will not be functioning in the future because of very little maintenance being done.

(1) Please TEST your SMOKE ALARM EACH WEEK (2) Please REPLACE your dead battery IMMEDIATELY NEVER remove your live battery for any reason REMEMBER a properly functioning smoke alarm is your first defense it is your night watchperson.

Place this handy checklist on the refrigerator door or near a phone so that it will be a constant reminder to test your smoke detector every week and place an "X" in the appropriate square for that week. Everyone should always be reminded to BE SAFETY CONSCIOUS.

The rescue alert kit is not intended to replace a smoke detectors and alarms which allows for warning [and the testing of which is a facet of this invention], or a fire extinguisher when available, but is intended to help a person escape from a fire. The most important factor for any fireman is to rescue any person from a burning building and the most difficult task in fire fighting is locating a person in a fire situation. It often happens that the person cannot leave their room and for this reason, the fire safety kit will be of immeasurable value. It will also be of value if the person does leave his immediate location and makes his way out of a burning building. Its presence on the premises will always serve as a reminder of what to do on a daily basis if you become involved in a fire situation.

In its use, the elastic strip is provided so that a person can slip it over his wrist and have it available at all times. The VELCRO™ on the elastic strip allows this kit to be positioned in a very visible location in every room wherein fire may occur. The location may be over a light switch or near a window. The whistle is important because it can be used to alert other family members, or alert fire fighters to the exact location of the person within a building. If that person is able to evacuate the building, it can alert others to the fact that he is out and safe so that no one will go in after him/her. Also, in higher buildings, a person may blow the whistle from a balcony or window to alert fire fighters to his location.

The importance of the attention flag is due to the fact that, as a rule, fire fighters will shine flashlights at every window to determine if there are any people in that room. The suction cap on the attention flag allows a person to stick the sign to the window glass and move it sideways to attract the light from the fire fighters.

The small handle is useful since it allows a person to slip it between his fingers and to open a window just enough to slip the sign through (and as not to allow for a back draft). The person would be able to move the sign up and down to attract attention. In the event that the person would lose consciousness, the sign would not slip through the window but would remain clutched in his hand or get stuck at the sill, indicating that someone is in that room.

The importance of the elastic strip on the safety light and that a person may slip the strap around his wrist and wave at a window to attract the fire fighters. It is easily seen through smoke.

The fire instructions directions are very important. A parent can teach the family what to do in case of a fire and can establish a predetermined escape plan. The fire safety kit instructions may be printed on a cardboard that would be inserted inside the bag and be visible from both faces.

Industrial Applicability

As described above, the present invention provides a rescue alert kit including a special vinyl case containing a whistle, a fold-out sign with specific attachments, a twelve hour high intensity safety light with an elastic strap, a general escape plan and training instructions, as well as a printed panel of instructions visible from both faces.

In more general terms, the rescue alert kit includes a clear vinyl bag or pouch or envelope with a VELCRO™ closure on either the top or side to permit fast, easy access to the contents within the bag. An elastic strip approximately 1" wide is sewn to the bag, or pouch, or envelope, at the top and bottom. On this elastic strip is sewn a small piece of VELCRO™ (both hook and pad). The rescue alert kit also includes an elastic loop that permits the kit to be hung on a doorknob. A very high decibel whistle (for example, the FOX™ 40 whistle with a 130 decibel count) is attached to the kit and is useful to alert people as to the exact location of the person. The rescue alert kit also contains a unique 3-way folded attention sign made of a reflective vinyl and printed with three fluorescent or phosphorescent or retroreflective signals that will shine in the dark. The symbols are the international symbols for "phone", "fire", and "SOS". The sign also has a small suction cup at the top. The sign also has a small handle secured to a cord.

As fully described above, the rescue alert kit of this invention is designed to work in a situation where the person cannot leave the room he is in and that his best chance for survival is to stay where he is and wait for the fire fighters to rescue him. However, it is also designed to slip on a person's wrist and be taken with the person as that person tries to escape the fire. In this way, should the person become trapped along the way, it may help save the person's life by allowing fire fighters to find the person quickly, e.g., either by the person blowing the whistle, or by having the safety light functioning around the person's other wrist, even in the event that the person became unconscious. The kit could also be as a protection for the person's fist should the person have to break a window on the way out or touch something that is hot.

We claim:

1. A portable light-weight compact rescue alert kit including means for attracting attention enabling rescuers to locate people in danger, comprising: (a) an envelope, said envelope being formed of thin, pliant material, and having an easily-openable and reclosable fastener at its opening; (b) a high decibel whistle secured to the exterior of said envelope; (c) means secured to the exterior of said envelope for hanging said envelope on a support or member, or for securing said envelope to a wall or to a body part; (d) a chemiluminescent safety light removably disposed within said envelope; (e) pre-printed fire evacuation safety instructions removably disposed within said envelope; and (f) an attention flag removably disposed within said envelope, said attention flag being made of, or being coated with, a material having phosphorescent or fluorescent or retro-reflective properties, and having a plurality of safety appliques thereon, said appliques being made from, or coated with, a material having fluorescent or phosphorescent or retro-reflective properties, said attention flag including a suction cup and a cord having a grip at the free end thereof secured thereto.

2. The kit of claim 1, further comprising a smoke alarm battery test checklist removably disposed within said envelope.

3. The kit of claim 1, wherein said envelope is transparent.

4. The kit of claim 1, wherein said means for securing or for hanging consists of a loop secured to said envelope, or consists of a band which is secured to the top and to the bottom of said envelope.

5. The kit of claim 1, wherein said chemiluminescent safety light, once activated, is adapted to shine for at least twelve hours, said light having a casing and also including an elastic loop secured to the casing.

6. The kit of claim 1, wherein said attention flag consists of a rectangular strip of vinyl plastic material divided by two score lines to enable folding thereof and to enable said folded-up attention flag to automatically become unfolded, said vinyl plastic material having a coating thereon of a phosphorescent or fluorescent day-and-night glow material.

7. The kit of any one of claims 1 to 6, inclusive characterized in that the safety appliques (53,54,55) are formed of synthetic plastic material having phosphorescent, fluorescent or retro-reflective properties.

8. The kit of claim 1, wherein said grip comprises a rod formed of a synthetic plastic having fluorescent or phosphorescent properties, said rod being tied to one free end of said cord.

9. The kit of claim 2, wherein said smoke alarm battery checklist consists of a flat, plastic or paper plate having either magnets on its rear face to be attachable to a magnetizable surface, or an adhesive surface on its rear face adapted for attachment to a smooth surface.

* * * * *